US012383103B2

(12) United States Patent
Moss et al.

(10) Patent No.: US 12,383,103 B2
(45) Date of Patent: Aug. 12, 2025

(54) BODY SCRUBBING DEVICE

(71) Applicants: Kenneth Moss, Louisburg, NC (US); Kathleen Moss, Louisburg, NC (US)

(72) Inventors: Kenneth Moss, Louisburg, NC (US); Kathleen Moss, Louisburg, NC (US)

( * ) Notice: Subject to any disclaimer, the term of this patent is extended or adjusted under 35 U.S.C. 154(b) by 381 days.

(21) Appl. No.: 17/575,771

(22) Filed: Jan. 14, 2022

(65) Prior Publication Data

US 2022/0218160 A1 Jul. 14, 2022

Related U.S. Application Data

(60) Provisional application No. 63/137,599, filed on Jan. 14, 2021.

(51) Int. Cl.
*A47K 7/02* (2006.01)

(52) U.S. Cl.
CPC ..... *A47K 7/022* (2013.01)

(58) Field of Classification Search
CPC ..... A47K 7/022; A47K 7/03
See application file for complete search history.

(56) References Cited

U.S. PATENT DOCUMENTS

| | | | | |
|---|---|---|---|---|
| 3,124,827 | A | 3/1964 | Hull | |
| 3,977,796 | A * | 8/1976 | Gillespie | A47K 7/022 15/222 |
| 5,545,456 | A | 8/1996 | Suida | |
| 6,851,154 | B1 * | 2/2005 | Neff | A47K 7/022 15/209.1 |
| 8,434,191 | B2 | 5/2013 | Shorees | |
| 2013/0098381 | A1 | 4/2013 | McBrayer | |

* cited by examiner

*Primary Examiner* — Shay Karls
(74) *Attorney, Agent, or Firm* — Boudwin Intellectual Property Law, LLC; Daniel Boudwin

(57) ABSTRACT

A multifunctional scrubbing tool is provided. The device includes a pouch with a pair of elastic members disposed on opposing ends of the pouch. The pouch further includes a plurality of apertures and a slit. A bar of soap or body wash may be inserted into the pouch via the slit. Each elastic member of the pair of elastic members further includes a handle. A user may insert their hands through the handle to hold and manipulate the pouch. The handle allows users to apply the pouch to be applied to a desired section of the body with ease. When the user pulls on the pair of elastic members in opposite directions, the slit is closed. When the slit is closed the bar of soap may remain encased in the pouch. The plurality of apertures on the pouch permits water and soap suds to pass through the pouch.

1 Claim, 2 Drawing Sheets

BODY SCRUBBING DEVICE

CROSS REFERENCE TO RELATED APPLICATIONS

This application claims the benefit of U.S. Provisional Application No. 63/137,599 filed on Jan. 14, 2021. The above identified patent application is herein incorporated by reference in its entirety to provide continuity of disclosure.

BACKGROUND OF THE INVENTION

The present invention relates to a multifunctional scrubbing tool. More specifically, the present invention provides a scrubbing tool that has a pouch centrally located between pair of elastic members having a flexible handle, wherein the pouch includes a plurality of apertures and a slit to access an internal volume.

People need to perform proper hygiene to maintain a healthy body. Moreover, it is important for people to remove dirt and oils from their skin. Failing to remove dirt and oils from the surface of the skin can lead the skin to become damaged. Managing proper hygiene can prevent individuals from suffering an illness or a disease. Typically, individuals will use some form of soap to provide the necessary cleansing of their skin. The soap can come in either a bar of soap or a liquid wash. For some individuals, there can be areas of their body that are difficult to reach. Even more so for individuals that lack dexterity due to age or a physical encumbrance. Specifically, those individuals have trouble reaching sections of their back. With the inability to apply soap and water to their back, they cannot remove the dirt or body oils that are present on their back. Additionally, people who do not possess a physical encumbrance may also have difficulty reaching other areas on their body with soap.

For the individuals that lack the ability to reach all areas of their body, they often must compensate to remove dirt and oils thereon. To compensate, these people typically must twist and contort their body to reach those parts of their body for cleaning. That twisting and contorting can be painful and may lead to an injury to the individual's muscles and joints. This type of physical movement might not even be plausible for individuals who do not suffer from any physical encumbrance. The use of cleaning devices may provide all individuals, regardless of the existence of an encumbrance, the ability to reach all areas of their skin for cleaning.

There are an abundance of different types of devices that can be used to assist individuals in cleaning the surface of their skin in difficult to reach areas. Such cleaning devices may include a standard washcloth or a loofah. These devices may be coupled with soap and water to become an effective cleaning device. However, these other cleaning devices can be incredibly difficult to use and may even be painful to use on an individual's skin. Depending on the size, some washcloths do not provide users with the necessary means to reach all areas on their body that require washing. Moreover, washcloths can have difficulty maintaining the necessary amount of soap to make for an effective cleaning device. Additionally, a loofah and similar devices include an extended member that allows the device to reach all areas of the body. However, the material used to clean an individual's skin which is disposed on the extended member of a loofah can be course and rigid. The course and rigid properties of a loofah can make them harmful to the skin. Specifically, when a user scrubs their skin with a loofah or similar cleaning device, the skin may become irritated and be painful to the user.

Therefore, there is a defined need amongst the known prior art references for a scrubbing tool that allows a user to clean all areas of their body by having a pouch centrally located between pair of elastic members, wherein the pouch includes a plurality of apertures and a slit to access an internal volume to allow for water and soap to pass through the pouch.

SUMMARY OF THE INVENTION

In view of the foregoing disadvantages inherent in the known types of multifunctional scrubbing tools now present in the known art, the present invention provides a new scrubbing tool having a pair of elastic members on opposing ends of a pouch, wherein the pouch includes a plurality of apertures and a slit to access an internal volume to place a bar of soap therein.

It is therefore an object of the present invention to provide a pouch that stores a bar of soap. The slit disposed on the pouch allows a user to place a bar of soap therein. When in the pouch, the user does not have to worry about trying to maintain a grip on a wet bar of soap. The pouch will properly secure the bar of soap. Additionally, the plurality of apertures disposed on the pouch will permit water to enter the internal volume of the pouch. When the water enters the pouch, the water will contact the bar of soap to generate soap suds. The soap suds may then exit the internal volume of the pouch via the plurality of apertures. When the pouch is in direct contact with a user's skin, the soap suds will be applied directly to the surface of the desired portion of skin to remove any dirt or oils thereon. The material of the pouch permits it to conform to the bar of soap. Conforming to the bar of soap allows for more soap suds to be applied to the user's skin.

Another aspect of the present invention is the pair of elastic members. The pair of elastic members provides the user with a plurality of features. A first feature is providing users with a means to hold the pouch. To position the pouch over a surface of the user's body that is typically hard to reach, the user will maneuver the pair of elastic members accordingly. The user will then continue to maneuver the pair of elastic members so that the pouch is placed over the desired portion of the skin surface to apply soap suds thereon. A second feature of the pair of elastic members is to secure items therein to the pouch. When the pair of elastic members are pulled in opposite directions, a tension state is created that prevents the slit disposed on the pouch from opening. Keeping the slit closed will prevent the items placed therein from falling out as the device is in use.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
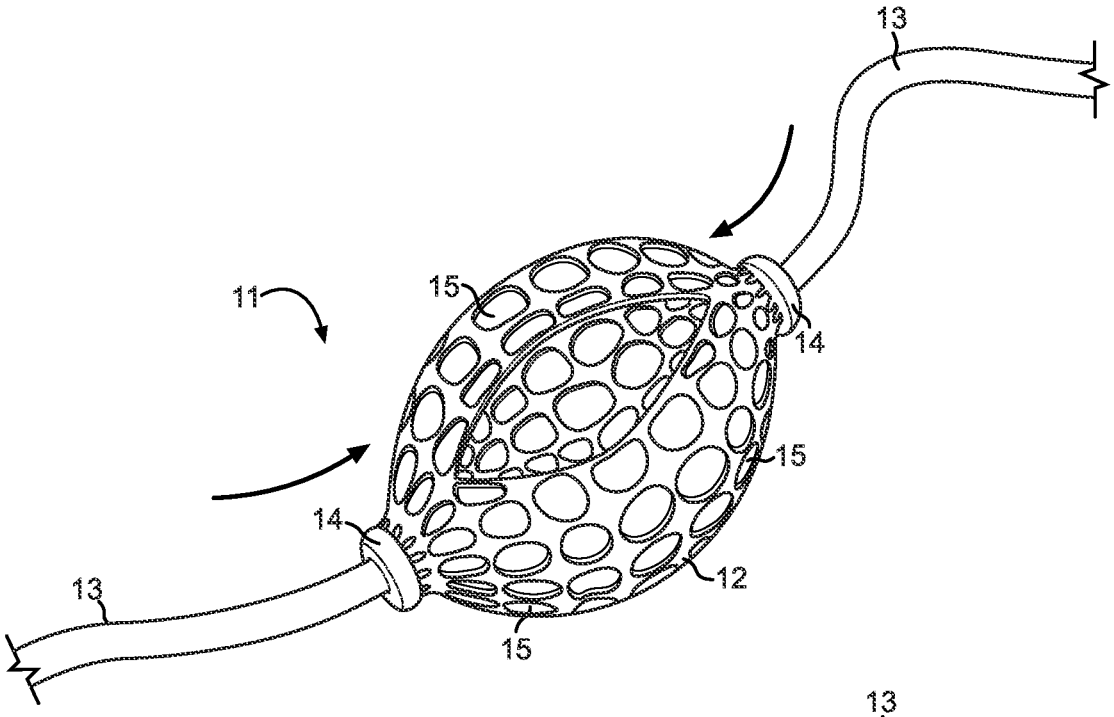
FIG. 1A shows a perspective view of an embodiment of the multifunctional scrubbing tool.

Reference is made herein to the attached drawings. Like reference numerals are used throughout the drawings to depict like or similar elements of the scrubbing tool. The figures are intended for representative purposes only and should not be limiting in any respect.

FIG. 1A shows a perspective view of an embodiment of a multifunctional scrubbing tool. The multifunctional scrubbing tool 11 includes a pouch 12 and a pair of elastic members 13. The pouch 12 is composed of a flexible material. The flexibility of the pouch 12 permits the pouch 12 to conform to items placed therein. In the shown embodiment, the pouch 12 is oblong shaped. A plurality of apertures 15 is disposed on the pouch 12. The plurality of apertures 15 have varying sizes depending on the location on the pouch 12. In the shown embodiment, the plurality of apertures 15 decrease in size towards the ends of the oblong shape. The plurality of apertures 15 create a mesh design of the pouch 12. The plurality of apertures 15 permit for liquids to pass through the pouch 12. The pair of elastic members 13 are disposed on opposing ends of the pouch 12. Each elastic member of the pair of elastic members 13 comprises an attaching end 14 and a handle end. The attaching end 14 of each elastic member of the pair of elastic members 13 is connected to the pouch 12. The attaching end 14 secures each elastic member of the pair of elastic members 13 to the pouch 12, so that the pouch 12 remains connected to the pair of elastic members 13 while the multifunctional scrubbing tool 11 is in use.

Figure 1B:
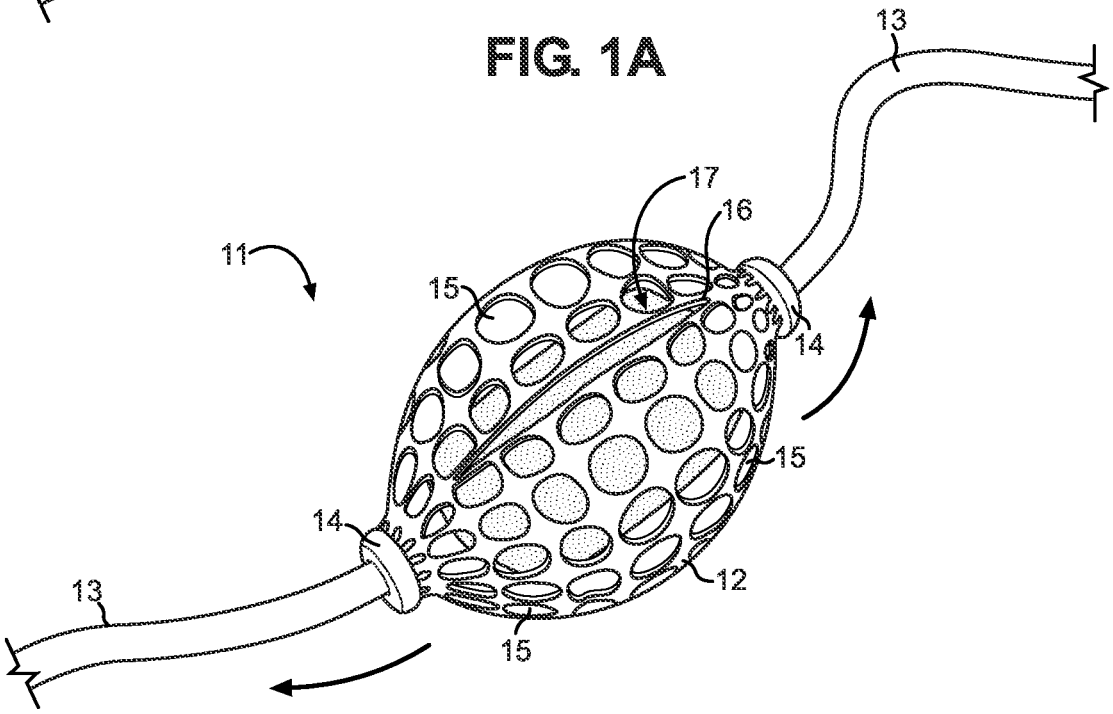
FIG. 1B shows a perspective view of an embodiment of the multifunctional scrubbing tool.

FIG. 1B shows a perspective view of an embodiment of a multifunctional scrubbing tool. The multifunctional scrubbing tool 11 may house a bar of soap or other items. The pouch 12 further comprises a slit 16. The slit 16 extends along the pouch 12 from the attaching end of a first elastic member of the pair of elastic members 13 to the attaching end of a second elastic member of the pair of elastic members 13. The slit 16 permits the bar of soap or other item to be placed within an internal volume 17 of the pouch 12. The slit 16 is aligned with the pair of elastic members' 13 longitudinal axis. This alignment of the slit 16 facilitates the closing of the slit 15 when the pair of elastic members 13 is pulled taut. In one embodiment, an adjustable elastic tightener encircles the slit 16. The adjustable elastic tightener biases the slit towards a closed position.

As the pair of elastic members 13 are pulled in opposite directions, the attaching end 14 of each elastic member of the pair of elastic members 13 will tighten the pouch 12 and prevent the slit 16 from opening wide enough for the bar of soap or other items to leave the internal volume 17. When the pair of elastic members 13 are not in a tension state, the pouch 12 may be opened. If the pouch 12 is opened, a bar of soap or other items may pass through the slit 16 to be placed within or taken out of the internal volume 17. When a bar of soap or any other item is placed with in the internal volume 17, water may enter the pouch 12 via the plurality of apertures 15 disposed on the pouch 12. Water will help break down the bar of soap within the internal volume 17 to generate the necessary soap suds to assist with cleaning the surface of a user's skin. The soap suds generated may also pass through the plurality of apertures 15 disposed on the pouch 12 to make direct contact with the surface of the user's skin.

Figure 2:
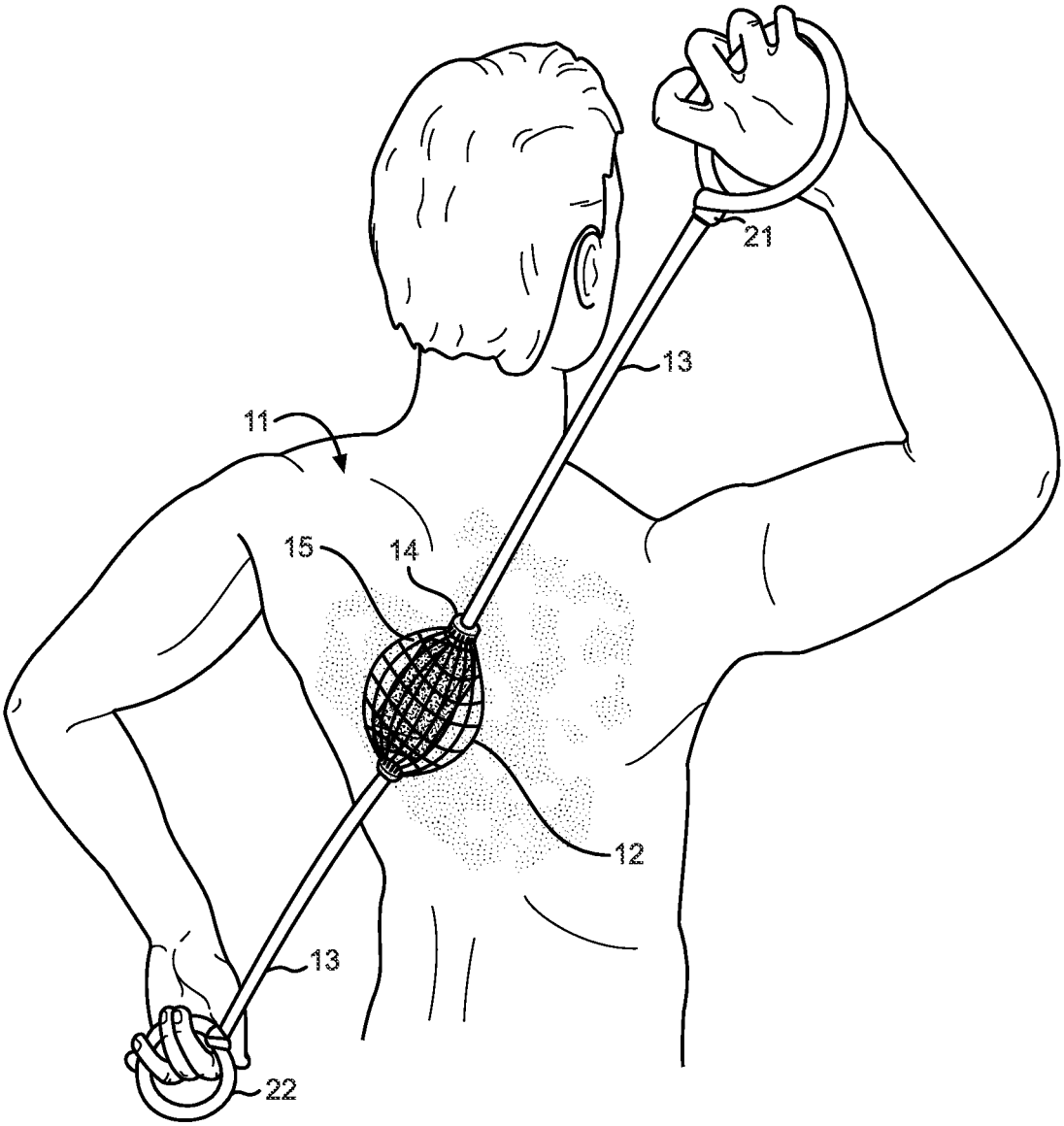
FIG. 2 shows a perspective view of an embodiment of the multifunctional scrubbing tool in use.

FIG. 2 shows a perspective view of an embodiment of a multifunctional scrubbing tool in use. In use, a user will place a bar of soap or other items within the internal volume of the pouch 12 of the multifunctional scrubbing tool 11. When the item is placed therein, the user may grasp a flexible handle 22 disposed on the handle end 21 of each elastic member of the pair of elastic members 13. The handle end 21 is on the opposing end of the elastic member from the attaching end 14. In one embodiment, the flexible handle 22 is a loop. In such embodiment, the user will place their hands through the loop to properly grab the flexible handle 22. When the user pulls on each flexible handle 22 in an opposite direction, a tension state is created. In the tension state, the attaching end 14 of each elastic member of the pair of elastic members 13 will secure the contents of the pouch 12 and prevent the contents from falling out of the internal volume. The user will then maneuver the pair of elastic members 13, so that the pouch 12 is placed on the area of their skin that they desire to clean. With water running, the user will alter the position of the pouch 12 along their body by adjusting the amount of tension created between the pair of elastic members 13. Water will pass through the plurality of apertures 15 disposed on the pouch 12 to generate soap suds from the bar of soap placed within the pouch 12. The soap suds generated will pass through the plurality of aperture 15 disposed on the pouch 12 to leave the pouch 12. The soap suds will make direct contact with the desired surface of the user's skin for cleaning. When the soap suds are washed away from the user's skin, the desired surface of the skin will be cleaned. At the conclusion of use, the user will release their grasp of the flexible handle 22. This will release the multifunctional scrubbing tool 11 from the tension state. Out of the tension state, the user may remove the remains of the bar of soap, or any other item placed within the pouch 12.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A multifunctional scrubbing tool, consisting of:

a pouch;

wherein the pouch is oblong shaped;

wherein the pouch further includes an internal volume;

a plurality of apertures disposed on the pouch;

wherein the plurality of apertures has varying sizes on the pouch;

wherein the plurality of apertures create a mesh design of the pouch;

a slit provides access to the internal volume;

wherein the slit is configured to permit a bar of soap placed within the internal volume of the pouch;

a pair of elastic members disposed on opposing ends of the pouch;

wherein the slit is opened when the pair of elastic members are not pulled in opposite directions;

wherein the slit is closed when the pair of elastic members are pulled in opposite directions;

wherein the pair of elastic members are maneuvered, so that the pouch is configured to be placed on a user's area that is desired to be cleaned;

wherein the position of the pouch along the user's area is determined by adjusting a tension state created between the pair of elastic members;

wherein each elastic member of the pair of elastic members has an attaching end and a handle end;

wherein the attaching end of an elastic member of the pair of elastic members is opposing the handle end of one of the elastic members of the pair of elastic members;

wherein the handle end further consisting of a flexible handle;

further wherein the flexible handle is a loop;

wherein the attaching end of each elastic member of the pair of elastic members is secured to opposing ends of the pouch;

wherein the slit extends along the pouch from the attaching end of a first elastic member of the pair of elastic members to the attaching end of a second elastic member of the pair of elastic members;

wherein the slit is aligned with a longitudinal axis of the pair of elastic members; and wherein the pouch is composed of a flexible material.

* * * * *